US007473194B2

(12) United States Patent
Nardacci

(10) Patent No.: US 7,473,194 B2
(45) Date of Patent: Jan. 6, 2009

(54) DIMPLED GOLF BALL AND DIMPLE DISTRIBUTING METHOD

(75) Inventor: Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 282 days.

(21) Appl. No.: 11/078,327

(22) Filed: Mar. 14, 2005

(65) Prior Publication Data

US 2005/0176525 A1 Aug. 11, 2005

Related U.S. Application Data

(63) Continuation-in-part of application No. 10/793,745, filed on Mar. 8, 2004, now Pat. No. 6,884,184, which is a continuation of application No. 10/237,680, filed on Sep. 10, 2002, now Pat. No. 6,702,696.

(51) Int. Cl.
*A63B 37/14* (2006.01)

(52) U.S. Cl. ..... 473/383; 473/378

(58) Field of Classification Search ..... 473/351–385
See application file for complete search history.

(56) References Cited

U.S. PATENT DOCUMENTS

| | | | | |
|---|---|---|---|---|
| 4,389,365 | A | 6/1983 | Kudriavetz | 264/297.8 |
| 4,720,111 | A | 1/1988 | Yamada | 273/232 |
| 4,765,626 | A | 8/1988 | Gobush | 273/232 |
| 4,778,493 | A | 10/1988 | Fitch et al. | 96/77 |
| 4,869,512 | A | 9/1989 | Nomura et al. | 273/232 |
| 4,959,000 | A | 9/1990 | Giza | 425/116 |
| 4,974,853 | A | 12/1990 | Morell | 273/232 |
| 5,441,276 | A | 8/1995 | Lim | 273/232 |
| 5,688,191 | A | 11/1997 | Cavallaro et al. | 473/373 |
| 5,688,194 | A | 11/1997 | Stiefel et al. | 473/383 |
| 5,713,801 | A | 2/1998 | Aoyama | 473/354 |
| 5,735,756 | A * | 4/1998 | Stiefel et al. | 473/382 |
| 5,772,532 | A | 6/1998 | Stiefel et al. | 473/384 |
| 5,803,831 | A | 9/1998 | Sullivan et al. | 473/374 |
| 5,885,172 | A | 3/1999 | Hebert et al. | 473/354 |
| 5,919,100 | A | 7/1999 | Boehm et al. | 473/354 |
| 5,965,669 | A | 10/1999 | Cavallaro et al. | 525/221 |
| 5,981,654 | A | 11/1999 | Rajagopalan | 525/66 |
| 5,981,658 | A | 11/1999 | Rajagopalan et al. | 525/72 |
| 6,056,842 | A | 5/2000 | Dalton et al. | 156/243 |
| 6,149,535 | A | 11/2000 | Bissonnette et al. | 473/354 |
| 6,168,407 | B1 | 1/2001 | Kasashima et al. | 425/116 |
| 6,213,898 | B1 * | 4/2001 | Ogg | 473/383 |

(Continued)

OTHER PUBLICATIONS

U.S. Appl. No. 2002/0123395.

(Continued)

*Primary Examiner*—Gene Kim
*Assistant Examiner*—Alvin A Hunter
(74) *Attorney, Agent, or Firm*—Hanify & King, P.C.

(57) ABSTRACT

A golf ball having a plurality of dimples on its surface, the dimples as a whole are distributed on at least a portion of the golf ball based on Soddy circles. The portion of the golf ball may be triangulated, and Soddy circles may be generated based on the vertices of each triangle. Dimples may then be arranged according to the generated Soddy circles. Alternately, dimples within the portion of the golf ball may be distributed based on circle packing.

25 Claims, 10 Drawing Sheets

U.S. PATENT DOCUMENTS

| | | | | |
|---|---|---|---|---|
| 6,231,463 | B1 * | 5/2001 | Tavares et al. | 473/378 |
| 6,254,496 | B1 | 7/2001 | Maehara et al. | 473/378 |
| 6,358,161 | B1 | 3/2002 | Aoyama | 473/383 |
| 6,398,667 | B1 | 6/2002 | Lemons | 473/374 |
| 6,548,618 | B2 | 4/2003 | Sullivan et al. | 528/76 |
| 6,699,143 | B2 | 3/2004 | Nardacci et al. | 473/378 |
| 6,702,696 | B1 | 3/2004 | Nardacci | 473/383 |
| 6,705,959 | B2 | 3/2004 | Morgan et al. | 473/383 |
| 6,796,912 | B2 | 9/2004 | Dalton et al. | 473/383 |
| 6,821,215 | B2 * | 11/2004 | Sajima | 473/382 |
| 6,824,476 | B2 | 11/2004 | Sullivan et al. | 473/374 |
| 6,835,794 | B2 | 12/2004 | Wu et al. | 528/64 |
| 2004/0087389 | A1 * | 5/2004 | Kasashima et al. | 473/383 |

OTHER PUBLICATIONS

U.S. Appl. No. 2002/0123390.
U.S. Appl. No. 2002/0025862 A1.
U.S. Appl. No. 2002/0028885 A1.
U.S. Appl. No. 2001/0009310 A1.
U.S. Appl. No. 10/077,090, filed Feb. 15, 2002 entitled "Golf Ball with Spherical Polygonal Dimples".
U.S. Appl. No. 2004/0171438.

* cited by examiner

DIMPLED GOLF BALL AND DIMPLE DISTRIBUTING METHOD

CROSS-REFERENCE TO RELATED APPLICATIONS

The present invention is a Continuation-in-Part of U.S. patent application Ser. No. 10/793,745, filed Mar. 8, 2004, now U.S. Pat. No. 6,884,184 entitled "Dimpled Golf Ball and Dimple Distributing Method," which is a continuation of U.S. patent application Ser. No. 10/237,680, filed Sep. 10, 2002, now U.S. Pat. No. 6,702,696, the disclosures of which are incorporated herein by reference.

FIELD OF THE INVENTION

This invention relates to a method of distributing dimples on a golf ball utilizing, for example, at least one of principles of electromagnetic field theory, Soddy circles, and circle packing theory.

BACKGROUND OF THE INVENTION

A number of physical phenomena are described by Laplace's equation including steady-state heat conduction, incompressible fluid flow, elastostatics, as well as gravitational and electromagnetic fields. The theory of solutions of this equation is called Potential Theory.

One example of Potential Theory is electromagnetic field theory, which can be used to distribute objects on a spherical surface. Electromagnetic field theory has been studied extensively over the years for a variety of applications. It has been used, for example, in satellite mirror design. Electromagnetic field theory, including the obvious applications to semiconductor research and computer technology, has many applications in the physical sciences, not limited to celestial mechanics, organic chemistry, geophysics, and structural acoustics.

In many applications, the objects are treated as point charges so that principles of electromagnetic field theory can be applied to determine optimal positioning or to predict the equilibrium position of the objects.

While the task of distributing point charges on a spherical surface has been studied extensively in mathematical circles, it has not been employed as a tool to develop and define dimple patterns or optimal dimple distributions on a golf ball.

Instead, current golf ball dimple patterns generally are based upon dividing the spherical surface of the ball into discrete polygonal surfaces. The edges of the surfaces join to form geometric shapes that approximate the spherical surface of a golf ball. These geometric shapes include, for example, regular octahedral, regular icosahedral and regular polyhedral arrangements. Once a geometric shape is selected, the polyhedral surfaces are individually filled with a dimple pattern that may be repeated over the surface.

While this approach may be effective in enabling easy dimple design and mold manufacture, it may not result in optimal dimple positioning or distribution for improved aerodynamic performance. In addition, this approach to designing a dimple pattern may result in a golf ball having variations in flight performance depending upon the direction of rotation of the ball. For instance, rotation about one axis may result in different flight characteristics than rotation about a second axis. Moreover, the difference may be large enough to produce a measurable and visible difference in aerodynamic lift and drag.

The potential limitations described above may be present in other methods for arranging dimples on a golf ball. Thus, it would be desirable to have a way to optimize a dimple pattern by repositioning the dimples to improve flight performance.

SUMMARY OF THE INVENTION

The present invention uses electromagnetic field theory to create dimple patterns and to optimize dimple placement and distribution on a golf ball. The method solves the constrained optimization problem where the objective function is an electric potential function subject to various constraints imposed, such as dimple spacing or size. A number of potential functions can be utilized to describe the point charge interactions. A variety of optimization methods are available to minimize the objective function including gradient based, response surface, and neural network algorithms. These solution strategies are readily available and known to one skilled in the art. One embodiment of the present invention uses a Coulomb potential function and a gradient based solution strategy to create a dimple pattern. One benefit from using these principles to develop dimple patterns is that doing so may result in a golf ball having improved aerodynamic performance.

Use of the inventive method provides a golf ball having a plurality of dimples on its surface, some of which have been positioned on the golf ball surface according to principles of electromagnetic theory. At first, the dimples that are to be positioned according to these principles may be randomly distributed on at least a portion of the golf ball surface. The ball surface may be divided into hemispheres, quadrants, or according to platonic solid shapes in order to define the portion of the golf ball on which the dimples will be arranged.

In one embodiment, the dimples are placed on a hemispherical portion of the golf ball. In another embodiment, the dimples are placed on the entire spherical portion of the ball. In yet another embodiment, the dimples are placed on the regions defined by an Archimedean solid, most preferably a great rhombicosidodecahedron.

The dimples may have any desired shape, although in a preferred embodiment the dimples are circular. In another embodiment, however, the dimples are polygonal in shape. In addition the dimples may be of any desired number. In one embodiment, the dimples are between about 200 to about 600 in number. In a preferred embodiment, the dimples are between about 300 to about 500 in number.

The size of the dimples may also vary. In one embodiment, the dimples are between about 0.04 to about 0.1 inches when measured from the centroid of the dimple to its outermost extremity. More preferably, the dimples are about 0.05 to about 0.09 inches in size. In yet another embodiment, the dimples are substantially circular and have varying diameters sizes from about 0.04 to about 0.20 inches, and more preferably are between about 0.100 and about 0.180 inches.

According to another aspect, the present invention comprises a method for arranging a plurality of dimples on a golf ball surface. The method includes defining a first portion of the golf ball surface in which dimples will be arranged, triangulating the first portion of the golf ball surface to form a triangulated surface pattern, generating Soddy circles based on the vertices of the triangulated surface pattern, and positioning dimples based on the Soddy circles.

The method further comprises modifying one or more Soddy circle radii if two or more circles overlap. In one embodiment, the first portion of the golf ball surface comprises the entire surface of the golf ball. In such an embodiment, it may be desirable for the dimple arrangement in the first portion to be repeated on other portions of the golf ball.

Generating a dimple pattern based on Soddy circles preferably results in a total dimple coverage that is about 60% or greater.

The dimple pattern may be generated in any desirable manner. Preferably, the triangulation and pattern generated are based on a computer program. In one embodiment, the triangulation comprises generating two or more triangulated surface patterns. The triangles may have any desired properties. For example, the angles of the triangles may comprise obtuse, oblique, equilateral, or any possible combination thereof. The computer program is preferably capable of randomly generating the triangulated surface pattern. However, other user defined criteria may be input into the computer program that may affect the generated dimple pattern. For example, the triangulated surface pattern may optionally be based on at least one of polyhedra and Archimedean solids.

In one embodiment, it may be desirable to further optimize the dimple pattern generated based on Soddy circles. This may be accomplished, for example, by optimizing the positioning of dimples based on the electromagnetic theory. Optimizing based on the electromagnetic theory includes defining a second portion of the golf ball surface in which dimples will be arranged, placing a first plurality of dimples within the defined surface, and assigning charge values to the dimples. Coulomb's Law is then applied to determine the potential of the charges. Lastly, a first solution method is applied to minimize the potential, and then the dimple location and distribution according to the solution method may be altered. In some embodiments, there may be regions within the first and second portions where no dimples can be defined. As will be understood by those skilled in the art, the properties of the dimples such as cross section and the like may be varied.

According to another aspect, the present invention comprises a method for arranging a plurality of dimples on a golf ball surface. The method includes defining a first portion of the golf ball surface in which dimples will be arranged and positioning dimples within the first portion based on circle packing. It is desirable for substantially all of the dimples to be mutually tangent to at least three neighboring dimples. However, in other embodiments the circles may be arranged such that at least some of them are mutually tangent.

According to this aspect of the present invention, the dimple pattern may be generated in order to achieve a total dimple coverage of about 80% or more. In one embodiment, the dimple pattern may be generated based on a predetermined number of different circle diameters, or a predetermined number of fixed circle positions. In another embodiment, it may be desirable for the pattern to be generated based on circles having two or more substantially different diameters or circles having substantially similar diameters.

According to an exemplary embodiment, the method may further comprise defining a second portion of the golf ball surface in which dimples will be arranged, triangulating the second portion of the golf ball surface to form a triangulated surface pattern, generating Soddy circles based on the vertices of the triangulated surface pattern, and positioning dimples based on the Soddy circles. In this exemplary embodiment, at least one dimple within the first portion overlaps at least one adjacent dimple within the second portion. When this occurs, the percentage overlap is preferably between about 1% and about 5%, and more preferably between about 2% and about 4%.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
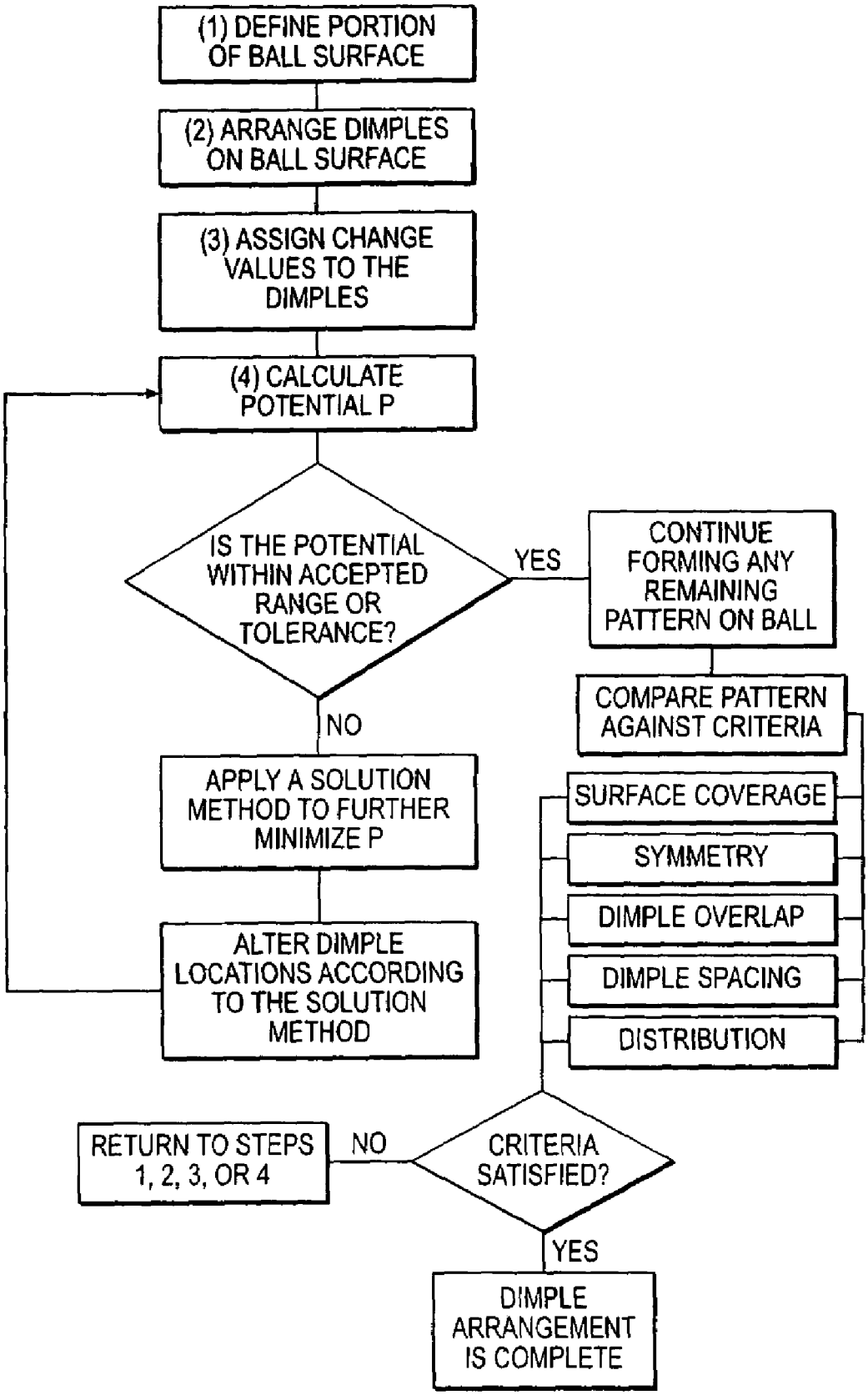
FIG. 1 illustrates one embodiment of a method of distributing four dimples on a golf ball according to the present invention.

As mentioned above, the present invention is directed to applying the principles of electromagnetic theory to develop dimple patterns for golf balls.

The foundation for the classical theory of electromagnetism is summarized by Maxwell's equations, which describe the phenomena of electricity, magnetism, and optics. These equations have a synonymous relationship with electromagnetism as Newton's Laws of motion and gravitation do with mechanics. Of particular interest in this discussion is Gauss's Law, which relate charge and the electric field generated as charged bodies interact. Electric charge is a fundamental attribute of matter as is mass, however it can be attractive or repulsive. The amount of attraction or repulsion between charged objects defines a measure of electric force. Coulomb's Law defines this vector quantity, for spherical Gaussian surfaces, as a function inversely proportional to the square of the distance between any two such charges. The following expression (Equation 1) defines Coulomb's Law:

$$\vec{F} = k\frac{q_1 q_2}{r^2} \tag{1}$$

where: F is the electric force;

$q_1$ and $q_1$ are the charges;

r is the distance between the charges; and k is a constant.

In the presence of multiple charges, forces are added vectorially to determine the total force on a particular charge. In many instances, it is convenient to introduce the concept of electric field. This quantity is the superposition of force on a charge placed in the neighborhood of a charge distribution of N charged bodies. In a sense, the charge can be thought of as a test charge, which probes the strength at various points within the electric field. The relationship between electric field and electric force can be expressed as follows (Equation 2):

$$\vec{F} = q\vec{E} \tag{2}$$

where: E is the electric field;

F is the electric force; and q is the test charge.

Substitution of equation 2 into equation 1 yields the expression for the electric field a distance r away from a point charge q (Equation 3):

$$\vec{E} = k\frac{q}{r^2} \tag{3}$$

In the presence of multiple charges, the electric field, E, is determined in a similar manner to that of electric force by vector addition of all charges q a distance r away.

The computation of vector quantities like electric force or electric field is manageable for a small number of charged bodies but quickly becomes unwieldy as the number of points increases. Fortunately, conservative forces such as electric charges have a convenient property, which allows the introduction of a scalar quantity called electric potential. In the presence of multiple charges, the total potential involves a straightforward summation of the individual charge potentials simplifying the calculation.

Further simplifications to the expression for the electric potential arise in instances where the field is constant with respect to time, known as electrostatics. For a constant electric field the electric potential energy, PE, is derived using work principles and Coulomb's Law to obey the following relationship (Equation 4):

$$PE = k\frac{q_1 q_2}{r} + C \tag{4}$$

Inclusion of the constant C in the equation q above allows the selection of the reference point where the potential is zero. Typically, this is chosen such that the potential is zero in the limit, as r becomes infinite. Under these conditions, the constant C equals zero. However, other choices are possible which provides the potential function to have other forms.

In practice, the application of electromagnetic field theory to develop dimple patterns may involve following the steps illustrated in FIG. 1. While the steps shown in FIG. 1 are illustrative of the present invention, one skilled in the art would appreciate that they may be varied or modified without departing from the spirit and scope of the invention. First, a portion of the ball is selected or defined for placing dimples. For instance, the defined space may approximately correspond to a hemispherical portion of the golf ball. Alternatively, the defined space may correspond to a portion of an Archimedean shape, a fractional portion of the curved surface of the ball. The defined space may be the entire ball surface. Other examples of suitable shapes that may be used to define a portion of the ball for placing dimples may be found in U.S. Pat. No. 6,705,959, entitled "Dimple Patterns for Golf Balls," filed on Feb. 21, 2002, which is incorporated by reference in its entirety.

Once the portion of the ball surface is defined, dimples may be initially arranged on the defined surface. The dimples may be placed randomly within the space or may be selected and arranged by any means known to those skilled in the art. In one embodiment, the dimples are initially arranged on the golf ball surface according to phyllotactic patterns. Such patterns are described, for instance, in U.S. Pat. No. 6,699,143, entitled "Phyllotaxis-Based Dimple Patterns," filed on Apr. 16, 2002, which is incorporated by reference in its entirety. Any additional techniques or patterns used for dimple arrangement known to those skilled in the art likewise may be used.

Once the dimples are arranged on the ball surface, each dimple is then assigned a charge value that can be used in the equations described above. Different charge values may be provided for dimples differing in size or shape in order to account for these differences. Alternatively, the dimples may be assigned similar charge values with differences in dimple sizes or shapes accounted for afterwards in any suitable manner.

The assigned charge values and positions of the dimples are then utilized to determine the potential energy PE, referred to from hereon as just the potential. Once the potential PE is determined, a solution method is then used to minimize PE. In one embodiment, the solution method used is gradient-based. The dimple locations are subsequently altered and the analysis is repeated until the potential PE reaches zero or an acceptable minimum within a specified tolerance. Examples of acceptable minimums may include when further iteration causes PE to change by less than 1 percent or ½ percent.

Any number of convergence criteria may be used to halt the optimization process. One skilled in the art will appreciate that error analysis and rate of convergence are essential elements in the implementation of any iterative numerical algorithm. Therefore, it is sufficient to note that an acceptable solution may be found when an appropriate convergence criteria or criterion is satisfied. If the potential PE is not within an accepted range or tolerance, the dimple locations are altered according to the gradient and the process is repeated. The potential PE is recalculated and compared again to the accepted range or tolerance. This process may be repeated until the dimple locations fall within acceptable tolerances.

More than one solution method may be utilized to further minimize the potential. For instance, numerical optimization can include a multi-method approach as well where a gradient method is used to identify a good initial guess at the minimum and then higher order methods, such as a Newton or Quasi-Newton methods, may be used to accelerate the rate of convergence. Once the potential PE is zero or within an accepted range or tolerance, the dimples no longer need to be repositioned.

As mentioned above, the arrangement of the dimples on the surface of the golf ball according to the concepts described herein may be performed on the entire surface of the golf ball or a portion thereof. In one embodiment, the surface is approximately half of the surface of the ball, preferably with allowance for dimples to not be placed near the parting line of the mold assembly. Thus, a portion of the surface of the golf ball, such as a mold parting line, may be designated as not being suitable for placement of dimples.

Likewise, portions of the golf ball surface may be configured with dimples that are not adjusted according to the methods described herein. For instance, the location and size of dimples on a golf ball corresponding to a vent pin or retractable pin for an injection mold may be selected in order to avoid significant retooling of molding equipment. Maintaining the selected size and position of these dimples may be accomplished by defining the portions of the ball where dimples will be arranged according to the methods described herein so that the defined portion of the ball surface excludes the dimples that are to remain in their selected position.

When the dimples are rearranged on only a portion of the golf ball, the pattern generated may be repeated on the remaining surface of the ball or on another portion of the golf ball. For instance, if the surface on which the dimples are arranged corresponds approximately to a hemisphere of the ball, the pattern may be duplicated on the remainder of the ball surface that corresponds to a similar approximation of a hemisphere. If the dimples are arranged on smaller regions, the pattern generated may be duplicated or repeated on other portions of the ball. Thus, it is not necessary that the totality of the defined spaces in which the dimples cover the entire golf ball. Any undefined spaces may have additional dimples added either before or after the process described herein for arranging dimples in the defined space.

Returning again to FIG. 1, once the potential is zero or within an accepted range or tolerance, any remaining portions or undefined spaces on the ball may be filled in with additional dimples. As mentioned above, dimples may be placed in these remaining portions or undefined spaces in any manner, including by use of the present invention. Once all of the dimples have been arranged on the ball, the pattern then may be compared to any combination of acceptance criteria to determine whether the dimple arrangement is complete.

Examples of suitable acceptance criteria may include, but are not limited to, surface coverage, symmetry, overlap, spacing, and distribution of the dimples. For example, a pattern having less than 65 percent dimple coverage may be rejected as not having sufficient dimple surface coverage, whereas a pattern having about 74 percent or more surface coverage may be acceptable. More preferably, the surface coverage of the pattern is about 77 percent or greater, and even more preferably is about 82 percent or greater.

Dimple distribution is another factor that may be included as part of the acceptance criteria of a dimple pattern. For instance, the pattern may be rejected if dimples of a particular size are concentrated in a localized area instead of being relatively uniformly distributed on the ball surface.

Dimple overlap and spacing are additional factors that may be considered when evaluating a dimple pattern. It is preferred that the outer boundary of one dimple does not intersect with the outer boundary of another dimple on the ball. If this occurs, either one or both of the overlapping dimples may be repositioned or altered in size in order to remedy the overlap. Once this dimple size or position has been altered, it may be desirable to reanalyze the Potential and apply a solution method until it reaches zero or an accepted range or tolerance. The same steps may also be taken when dimple spacing is at issue instead of dimple overlap. Thus, dimples deemed too close to each other or perhaps too close to a particular region of the ball, such as the parting line of the mold, may be resized or repositioned in the manner described above.

As stated above, any combination of acceptance criteria may be used to evaluate the dimple pattern. If the acceptance criteria are met, dimple arrangement is complete.

However, if any of the selected acceptance criteria is not met, any one of steps 1-4 as indicated in FIG. 1 may be repeated to further modify the dimple pattern and reevaluate the pattern against the acceptance criteria. Thus, the portion of the ball surface may be redefined, the dimples may be rearranged, different charge values may be assigned to one or more dimples to reflect a new dimple diameter, or the Potential of the overall dimple pattern may be calculated and further minimized. It should be noted that the number designations shown for steps 1-4 in FIG. 1 do not denote that these steps must be completed or performed in any particular order. Thus, for instance, step 3 may be performed prior to performing step 2.

The arranged dimples may be of any desired size or shape. For example, the dimples may have a perimeter that is approximately a circular plane shape (hereafter referred to as circular dimples) or have a perimeter that is non-circular. Some non-limiting examples of non-circular dimple shapes include oval, triangular, rhombic, rectangular, pentagonal, polygonal, and star shapes. Of these, circular dimples are preferred. A mixture of circular dimples and non-circular dimples is also acceptable, and the sizes of the dimples may be varied as well. Several additional non-limiting examples of dimple sizes and shapes that may be used with the present invention are provided in U.S. Pat. No. 6,358,161, filed Sep. 27, 1999, entitled "Golf Ball Dimple Patterns," and U.S. Pat. No. 6,213,898, the entire disclosures of which are incorporated by reference herein.

In addition to varying the perimeter and size of the dimples, the cross-sectional profile of the dimples may be varied. In one embodiment, the profile of the dimples correspond to a curve. This embodiment is described in further detail in U.S. Pat. No. 6,796,912, entitled "Golf Ball Dimples with a Catenary Curve Profile" filed on Nov. 21, 2001, which is incorporated by reference herein in its entirety. Another example of a cross-sectional dimple profile that may be used with the present invention is described in U.S. application Ser. No. 10/077,090, entitled "Golf Ball with Spherical Polygonal Dimples" filed on Feb. 15, 2002, which also is incorporated by reference herein in its entirety. Other dimple profiles, such as spherical ellipsoidal, or parabolic, may be used as well without departing from the spirit and scope of the present invention. In addition, the dimples may have a convex or concave profile, or any combination thereof.

As mentioned above, the defined space for arranging the dimples may approximately correspond to a hemispherical portion of the golf ball, although smaller or larger regions also may be selected. Defining the space in this manner may have particular benefit when the mold that forms the cover has a parting line near the hemisphere of the ball.

The defined space may be selected to correspond approximately to a cavity formed by one mold plate. In this situation, a boundary layer or region may be imposed near the parting line of the mold so that the dimples are not formed too close to where the mold plates meet. For instance, a boundary layer may be imposed so that no portion of a dimple is formed within 0.005 inches or less of the mold parting line. Preferably, this boundary layer would be approximately the same distance from the parting line on the corresponding mold plate.

This technique for defining the space to correspond to a mold cavity may be used even if the corresponding mold plates do not have the same dimensions or configurations. For instance, the parting line of the mold may be offset, as described for instance in U.S. Pat. No. 4,389,365 to Kudriavetz, the disclosure of which is incorporated by reference in its entirety. Additionally, the parting line of the mold may not occur in a single plane, as described for example in U.S. Pat. No. 6,705,959, which is incorporated herein by reference. Other molds may have dimples that cross the parting line such described in U.S. Pat. No. 6,168,407, which is incorporated by reference in its entirety. It is not necessary, however, that the defined space is limited to space formed by a single mold plate.

Application of the present invention is not limited to any particular ball construction, nor is it restricted by the materials used to form the cover or any other portion of the golf ball. Thus, the invention may be used with golf balls having solid, liquid, or hollow centers, any number of intermediate layers, and any number of covers. It also may be used with wound golf balls, golf balls having multilayer cores, and the like. For instance, the present invention may be used with a golf ball having a double cover, where the inner cover is harder than the outer cover. If a double cover is used with the present invention, it is preferred that the difference is Shore D hardness between the outer cover and the inner cover is at least about 5 Shore D when measured on the ball, and more preferably differs by about 10 or more Shore D.

Other non-limiting examples of suitable types of ball constructions that may be used with the present invention include those described in U.S. Pat. Nos. 6,056,842, 6,824,476, 6,548,618, 5,688,191, 5,713,801, 5,803,831, 5,885,172, 5,919,100, 5,965,669, 5,981,654, 5,981,658, and 6,149,535. The entire disclosures of these patents and published applications are incorporated by reference herein.

The invention also is not limited by the materials used to form the golf ball. Examples of suitable materials that may be used to form different parts of the golf ball include, but are not limited to, those described in U.S. Pat. No. 6,835,794, entitled "Golf Balls Comprising Light Stable Materials and Method of Making the Same," filed on Aug. 27, 2002, the entire disclosure of which is incorporated herein. In one embodiment of the present invention, the outer cover material comprises a polyurethane composition, while in another embodiment the cover is formed from a polyurea-based composition.

According to another aspect of the present invention, a dimple pattern may be chosen based on one or more geometric shapes. In one embodiment, the dimple pattern generated by the geometric shapes does not require further optimization. However, in some applications it may be desirable to further optimize the dimple pattern based on geometric shapes by assigning each dimple a charge value, as described above.

In one embodiment a dimple pattern may be based on a geometric shape such as circles. In particular, Soddy circles may be used to generate a dimple pattern. Soddy circles are defined in plane geometry where, for any three distinct non collinear points, three circles can be drawn centered at these points and having radii such that the three circles are substantially tangent. The Soddy circles may be mapped onto the surface of the golf ball in any desired manner. In one embodiment, this may involve triangulating all, or a portion of, the spherical surface of the golf ball.

In the foregoing description, it will be understood that the triangulated surface patterns and Soddy circles are not actually placed on the surface of the golf ball. Rather, the patterns and circles represent guides that represent the placement of dimple centers and sizes of the dimples. The patterns and circles may be generated using, for example, a processing device that is capable of executing computer instructions in order to determine a desired arrangement of dimples.

In one embodiment, the entire sphere, or a portion of the spherical surface of the golf ball is triangulated using a computing device. Preferably, the computing device includes a processor, input circuitry, output circuitry, memory, display, operating system, and the like. The present invention is not intended to be limited to any specific computing device, processor, or processing speed. Any software may be used to generate the triangulated surface patterns and the subsequent Soddy circles. For example, commercially available software, GNU ware, or user specific code may be used to generate triangulated surface patterns.

Those skilled in the art will recognize that the present invention is not limited to any specific triangulated pattern or patterns. For instance, the triangles forming the triangulated pattern may comprise any angles including oblique, obtuse, equilateral, or any possible combinations thereof. The length of each side of the triangle may also be varied as desired. Additionally, the present invention is not intended to be limited to any number of triangles within a specific region on the spherical surface.

In one embodiment, it may be possible to generate a triangulated pattern based on triangles comprising substantially similar properties. In other words, a triangulated pattern may comprise triangles having substantially similar properties, such as size, shape, angle, and the like. In other embodiments, a triangulated pattern may comprise triangles having varied properties. In one embodiment, the triangulated pattern may be generated randomly based on the computing device. Alternately, the triangulated pattern may be generated based on user defined triangles or other parameters.

The triangulated pattern may be mapped to the entire surface of the golf ball, or alternately it may be mapped to only a portion of the golf ball. The portion may or may not include the equator of the golf ball. In some embodiments, it may be desirable to use two or more different triangulated patterns to generate a dimple pattern. In such an embodiment, the two or more triangulated patterns may be mapped to different portions of the surface of the golf ball. It may be desirable to map two or more triangulated patterns to the same portion of the golf ball in order to generate yet another triangulated pattern based on their combination.

In another embodiment, it may be desirable for two or more patterns to overlap by only a predetermined amount. In one embodiment, the two or more patterns may overlap by about 25% or less. More preferably, the two or more patterns may overlap by about 15% or less. Most preferably, the two or more patterns may overlap by about 5% or less.

Based on the software described above, the one or more triangulated patterns may be randomly generated. In another embodiment, the triangulated surface patterns may be arranged with specific symmetries based on, for example, triangle vertex positions, manufacturing process considerations, polyhedra, Archimedean solids, and the like.

After one or more triangulated patterns have been generated and mapped to the surface of the golf ball, Soddy circle radii may be computed for each triangle. This may be done through the use of the computer software described above. As a result, each triangle will have a set of Soddy circles, each one substantially centered at each vertex of a given triangle. As will be appreciated by those skilled in the art, each Soddy circle represents the placement of a golf ball dimple with an appropriate diameter or enclosed domain.

It is possible for more than one set of Soddy circles to be computed for each vertex point. This may cause Soddy circles of adjacent triangles to overlap. This may or may not result in an arrangement that is desirable. Thus, the computer software should be capable of choosing appropriate radii based on user specific criteria for Soddy circles of adjacent triangles.

Figure 8:
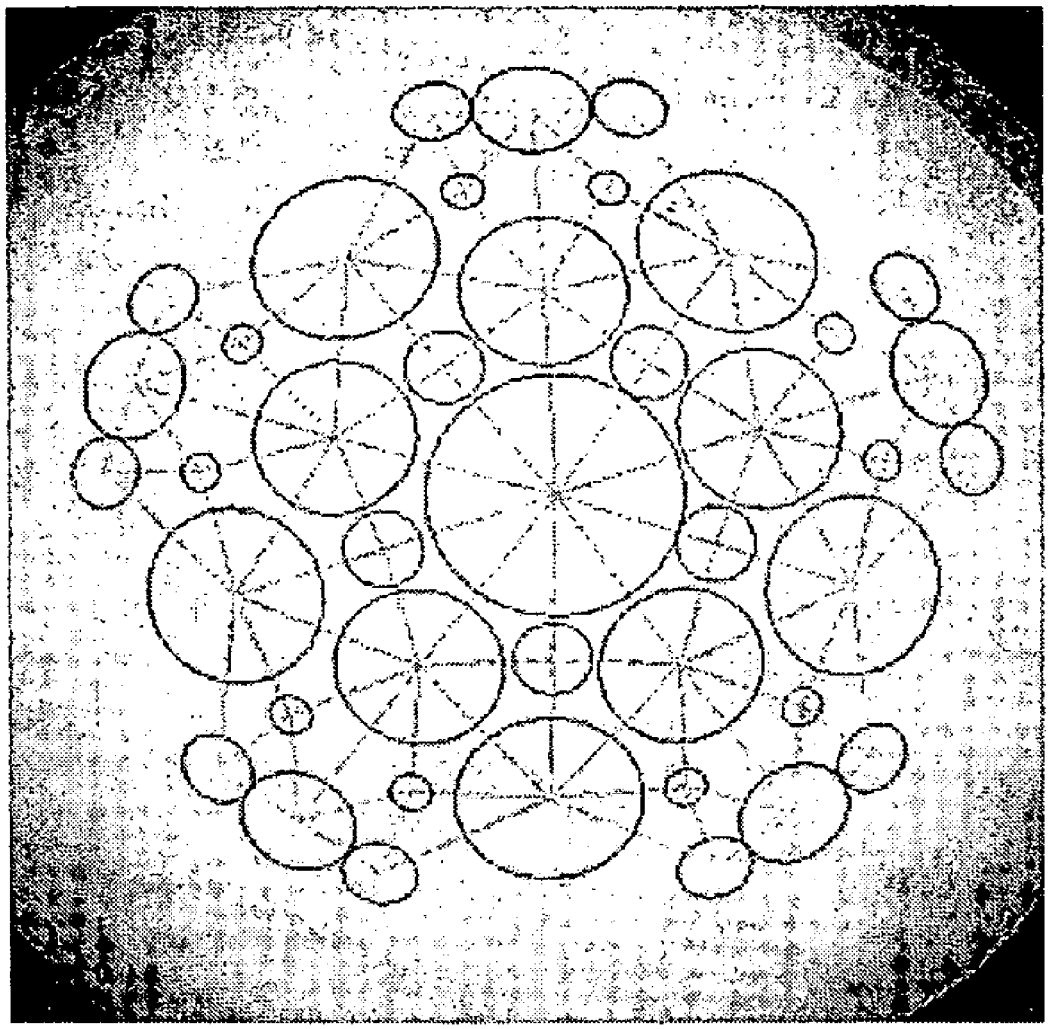
FIGS. 8-10 are diagrams showing exemplary dimple patterns according to one aspect of the present invention.
Figure 9:
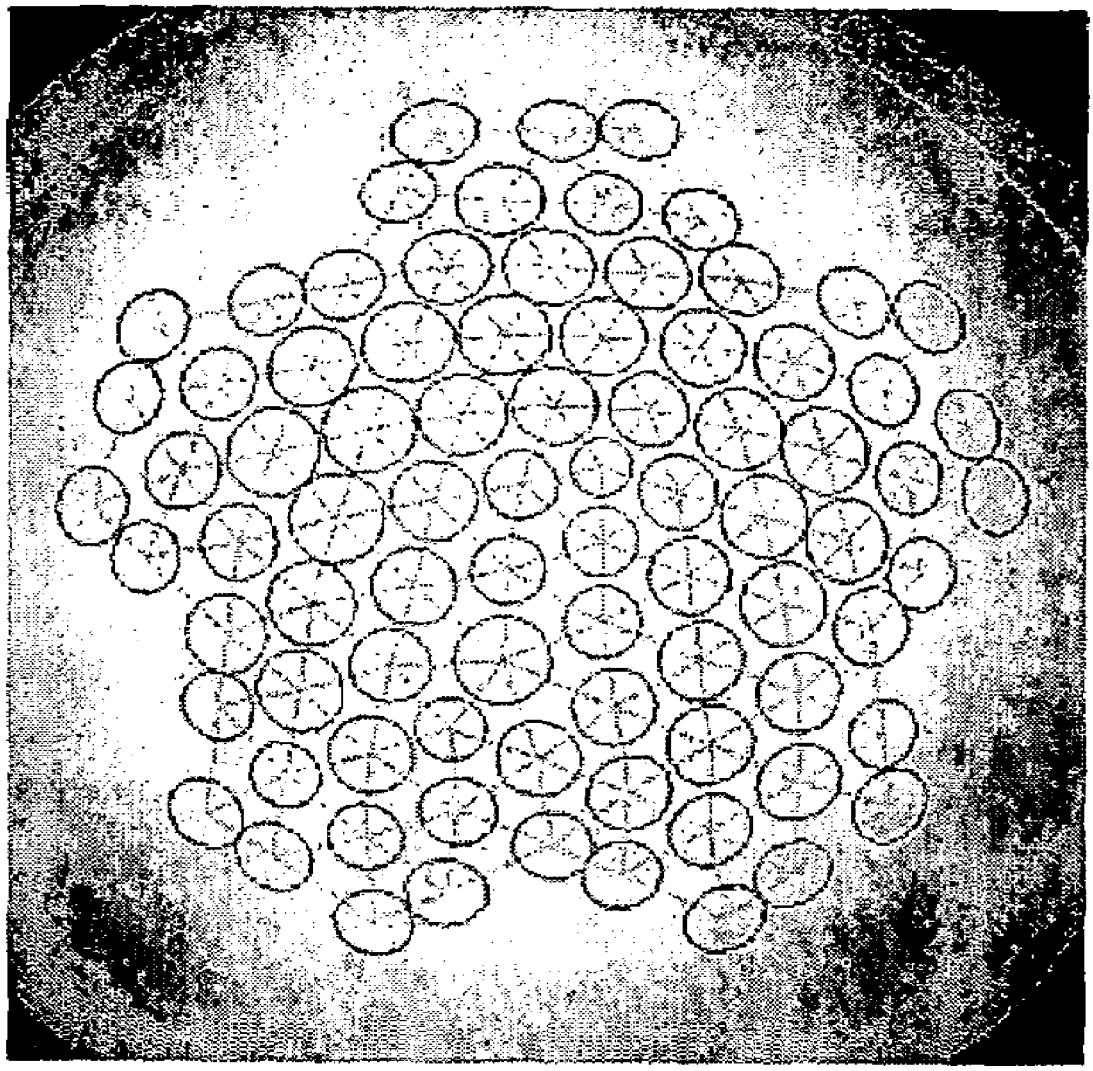
Figure 10:
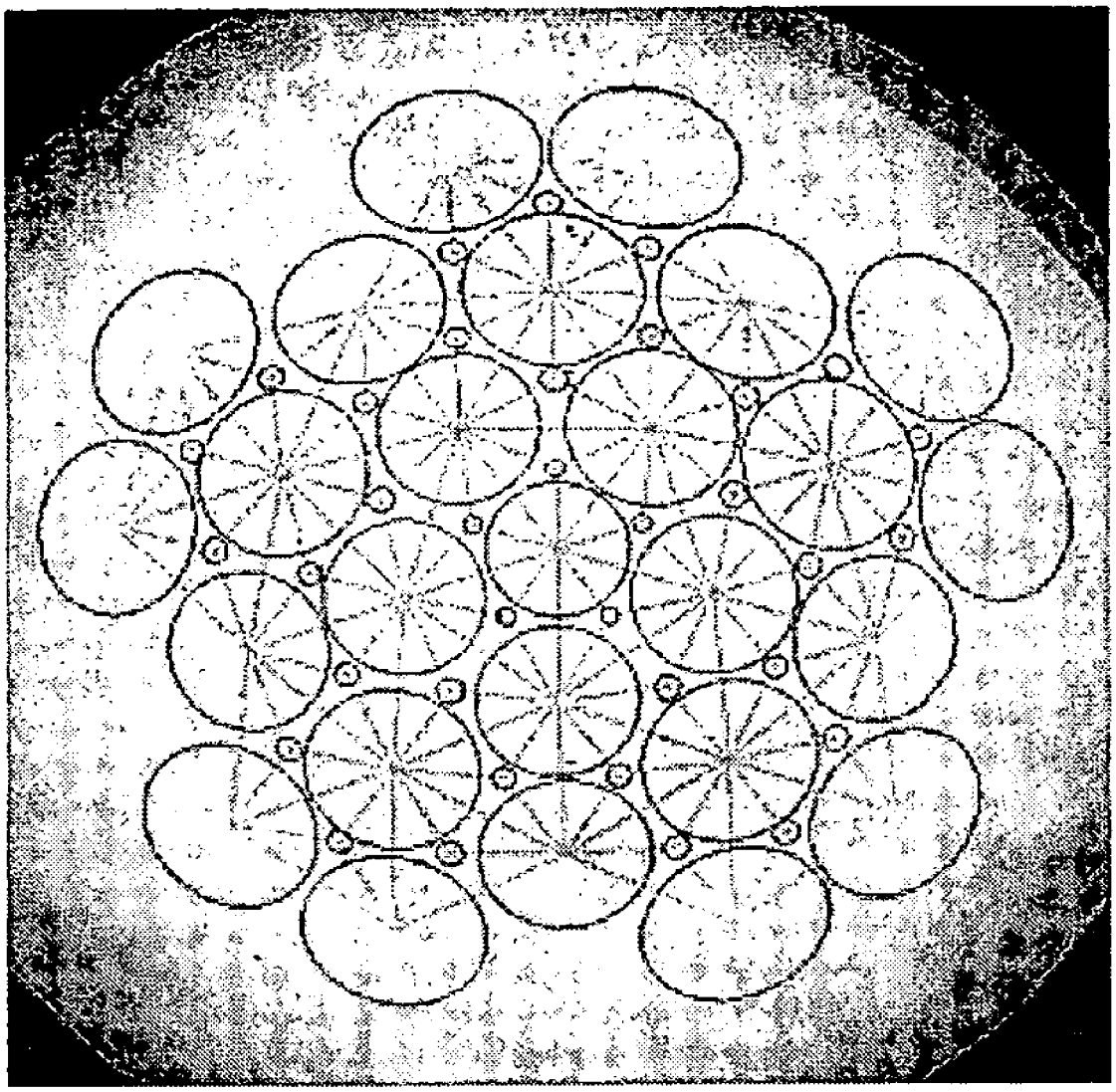

According to this aspect of the present invention, any number of dimple diameters or dimple packing may be generated. FIGS. 8-10 are diagrams showing exemplary triangulated surfaces having Soddy circles substantially centered at each vertex. The triangulated surface patterns shown in the figures are three possible packings of a polygonal region on a sphere based on the dual polyhedra for a snub dodecahedron. The present invention is not intended to be limited to a snub dodecahedron, and any other shape known to those skilled in the art may be used.

In addition to having varying radii, each dimple may have varied properties, such as profile, dimple depth, chord depth, and the like. These properties may be substantially similar or substantially different for each dimple. For example, it may be desirable to have all of the dimples having a substantially similar radius to have the same properties. Alternately, dimple properties may be chosen based on the location of the dimples on the surface of the golf ball.

In one embodiment, the total dimple coverage of the dimple pattern generated by the triangulated surface pattern and Soddy circles may cover about 50% or more of the surface of the golf ball. More preferably, the total dimple coverage may be about 60% or more of the surface of the golf ball. Most preferably, the total dimple coverage may be about 75% or more of the surface of the golf ball.

According to another aspect of the present invention, a dimple pattern may be generated based on circle packing. A circle packing is an arrangement of circles on any given Riemann Surface such that no two circles are tangent in more than one place to one another. According to this aspect of the present invention, a computing device such as the one described above is capable of generating unique golf ball dimple patterns based on circle packing. This may be accomplished by using, for example, GNU ware. Examples of GNU ware that may be used include, but are not limited to, SC Toolbox, DSCPack, ConfPack, Zipper, CirclePack, and the like.

Preferably, the computing device is capable of executing computer program instructions that are capable of solving a discrete conformal mapping of circles to a portion of, or complete spherical surface. Thus, the computer program is preferably capable of mapping circles to a portion or the entirety of the spherical surface of the golf ball. Those skilled in the art will understand that the circle packing serves as a guide for dimple arrangement, and is not physically mapped onto the surface of the golf ball. The dimple pattern generated based on circle packing does not require further optimization. However, in some applications it may be desirable to further optimize the dimple pattern based on the electromagnetic theory, as described above.

In one embodiment, the computer program may develop a circle packing that has, for example, a desired symmetry. This symmetry may be of aerodynamic benefit as well as for ease of manufacture. Preferably, the dimples are arranged such that substantially all of the dimples are mutually tangent to at least three neighboring dimples.

According to one aspect of the present invention, the characteristics of the circles may be varied. For example, in one embodiment the maximum or minimum diameter of the circles may be limited. This may be desirable, for example, in order to change the percentage of the surface covered by dimples or to change the effectiveness of the dimple pattern in changing the flight characteristics of the ball. Alternately, the maximum or minimum number of different circle diameters may be specified. Optionally, a predetermined number of fixed circle positions may be user defined. The present invention is not limited to these variations. Other aspects, such as the space between adjacent dimples, the tangency of adjacent dimples, dimple cross section, and the like may be varied.

In an alternate embodiment, the circle packing may be generated based on the desired total dimple coverage measured as, for example, a percentage of the total surface area of the golf ball. It is desirable for the computer program to be capable of receiving instructions related to total dimple coverage. As such, the computer program is preferably capable of generating a circle packing that provides the desired dimple coverage.

According to this aspect of the present invention, a dimple coverage of about 60% or greater may be achieved. More preferably, a dimple coverage of about 70% or greater may be achieved. Most preferably, a dimple coverage of about 80% or greater may be achieved.

EXAMPLES

In addition to the description above, the following examples further illustrate how the present invention can be used to arrange dimples on a golf ball.

FIGS. 2-7 show the initial and final point configurations for three examples described more fully below. Tables 1-3, also provided below, show run history information of the computed potential energy and gradient for the iterative analysis previously described. Additional fields provide a measure of the point separation as the run progresses. The key elements in the tables are the computed potential, the gradient of the computed and known minimum potential values and minimum spacing. In examples 1 and 2, there is good agreement between the computed and known minimum potential values and minimum spacing distances.

A tighter convergence tolerance would further increase the level of accuracy. Tables 1 and 2 show the tabulated data and plot of iteration count versus the computed gradient. As shown, the gradient approach has a linear rate of convergence. While improvements on solution speed and accuracy may be gained by utilizing more robust algorithms, the implementation of the inventive method described herein nevertheless sufficiently describes the utility of the method.

Example 1

Figure 2:
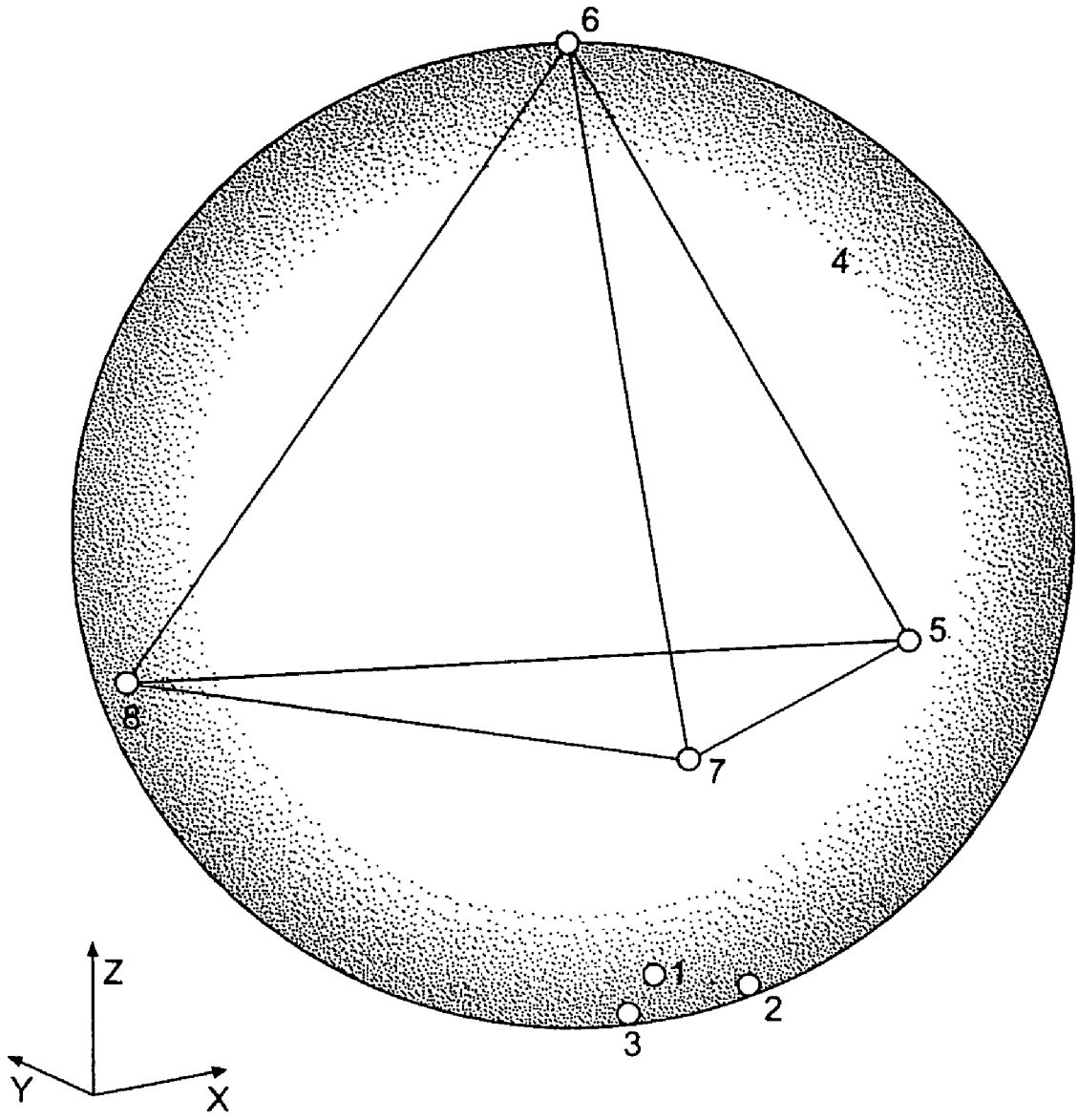
FIG. 2 is an example of a dimple arrangement according to the present invention.

The first example, shown in FIG. 2, utilizes only four points to provide a simplified illustration of how the present invention can be used to arrange dimples on a spherical surface. In this example, the defined surface corresponds to a unit sphere. The four points are randomly placed in any location on the surface of the sphere, as represented by numbers 1-4, and assigned identical charge values. Using a computer, the potential, gradient, minimum distance between any two points and average distance between all of them is calculated. The dimples are then repositioned according to a gradient based solution method and reevaluated. As shown in FIG. 1, and as further illustrated in Table 1 below, this process is repeated in this example until the gradient is approximately zero.

TABLE 1

| Iteration No. | Potential PE | Gradient | Minimum Distance | At Vertices | Average Distance |
|---|---|---|---|---|---|
| 1 | 8.205 | 12.230 | 0.5039 | 0, 1 | 1.1331 |
| 26 | 4.422 | 1.520 | 1.076 | 0, 1 | 1.4273 |
| 51 | 4.069 | 0.925 | 1.2469 | 0, 1 | 1.5165 |
| 76 | 3.914 | 0.663 | 1.3412 | 0, 1 | 1.5626 |
| 101 | 3.829 | 0.505 | 1.4027 | 0, 1 | 1.5889 |
| 126 | 3.779 | 0.398 | 1.4466 | 0, 1 | 1.6048 |
| 151 | 3.746 | 0.321 | 1.4797 | 0, 1 | 1.6146 |
| 176 | 3.725 | 0.263 | 1.5057 | 0, 1 | 1.6208 |
| 201 | 3.711 | 0.219 | 1.5265 | 0, 1 | 1.6248 |
| 226 | 3.700 | 0.184 | 1.5436 | 0, 1 | 1.6274 |
| 251 | 3.693 | 0.156 | 1.5571 | 0, 2 | 1.6292 |
| 276 | 3.688 | 0.132 | 1.5684 | 0, 2 | 1.6303 |
| 301 | 3.684 | 0.113 | 1.578 | 0, 2 | 1.6311 |
| 326 | 3.682 | 0.097 | 1.5862 | 0, 2 | 1.6317 |
| 351 | 3.680 | 0.083 | 1.5932 | 0, 2 | 1.6321 |
| 376 | 3.678 | 0.071 | 1.5993 | 0, 2 | 1.6323 |
| 401 | 3.677 | 0.060 | 1.6044 | 0, 2 | 1.6325 |
| 426 | 3.676 | 0.051 | 1.6088 | 0, 2 | 1.6327 |
| 451 | 3.676 | 0.044 | 1.6125 | 0, 2 | 1.6328 |
| 476 | 3.675 | 0.037 | 1.6157 | 0, 2 | 1.6328 |
| 501 | 3.675 | 0.032 | 1.6184 | 0, 2 | 1.6329 |
| 526 | 3.675 | 0.027 | 1.6207 | 0, 2 | 1.6329 |
| 551 | 3.675 | 0.023 | 1.6226 | 0, 2 | 1.6329 |
| 576 | 3.675 | 0.019 | 1.6242 | 0, 2 | 1.633 |

TABLE 1-continued

| Iteration No. | Potential PE | Gradient | Minimum Distance | At Vertices | Average Distance |
|---|---|---|---|---|---|
| 601 | 3.674 | 0.016 | 1.6256 | 0, 2 | 1.633 |
| 626 | 3.674 | 0.014 | 1.6268 | 0, 2 | 1.633 |
| 651 | 3.674 | 0.012 | 1.6278 | 0, 2 | 1.633 |
| 676 | 3.674 | 0.010 | 1.6286 | 0, 2 | 1.633 |
| 701 | 3.674 | 0.008 | 1.6293 | 0, 2 | 1.633 |
| 726 | 3.674 | 0.007 | 1.6299 | 0, 2 | 1.633 |
| 751 | 3.674 | 0.006 | 1.6304 | 0, 2 | 1.633 |
| 776 | 3.674 | 0.005 | 1.6308 | 0, 2 | 1.633 |
| 801 | 3.674 | 0.004 | 1.6311 | 0, 2 | 1.633 |
| 826 | 3.674 | 0.004 | 1.6314 | 0, 2 | 1.633 |
| 842 | 3.674 | 0.003 | 1.6316 | 0, 2 | 1.633 |

Figure 3:
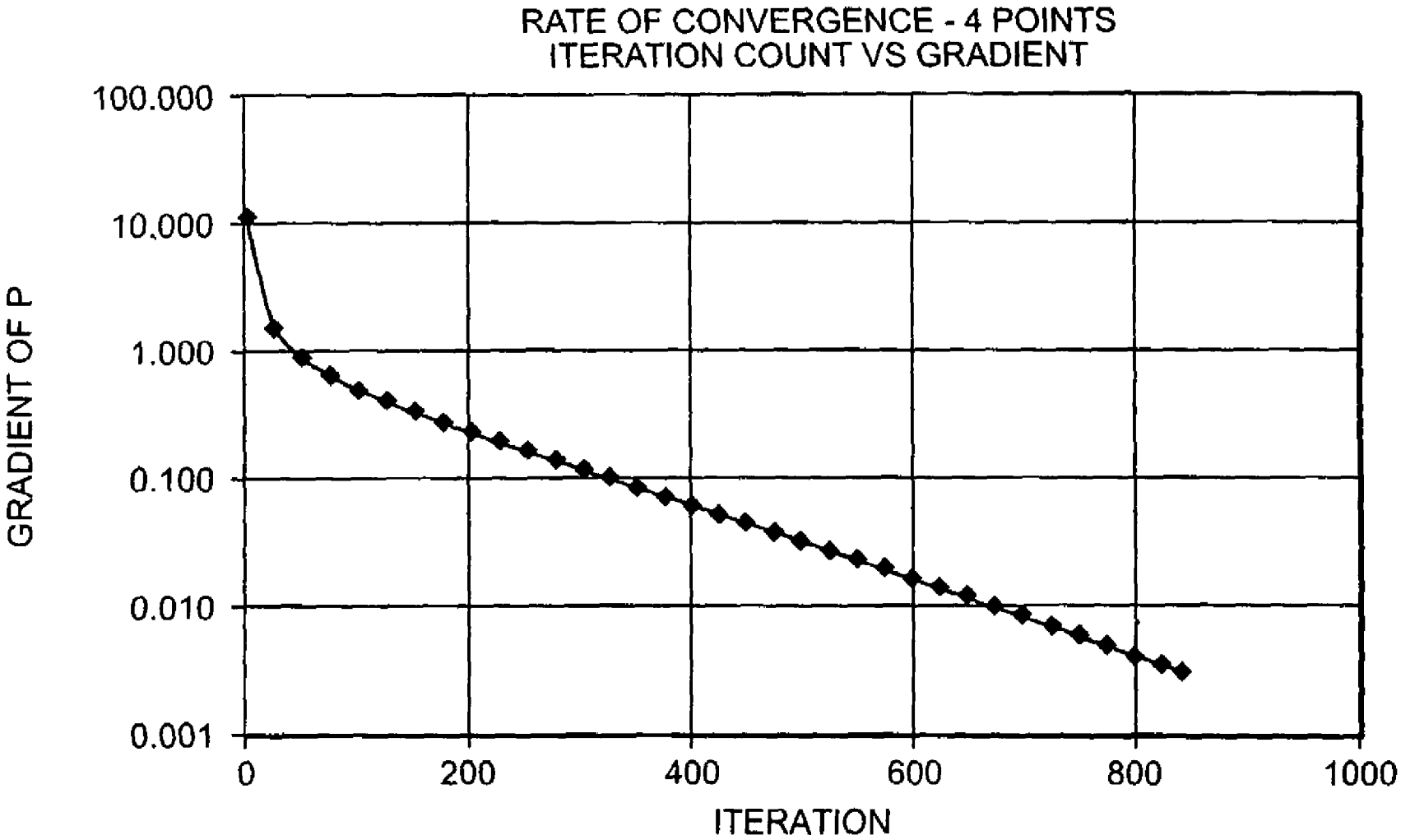
FIG. 3 is a graph of the rate of convergence for the example illustrated in FIG. 2.

The resulting point locations 5-8 derived using the inventive method described herein are shown in FIG. 2. Each point is approximately the same distance, in this case about 1.63 inches, from any other point arranged on the sphere. FIG. 3 is a graph of the rate at which the gradient converges to zero. As shown, the rate of convergence is generally linear for the solution method used in this example. The process was stopped after 842 iterations when the gradient reached a value that was approximately zero.

Example 2

Figure 4:
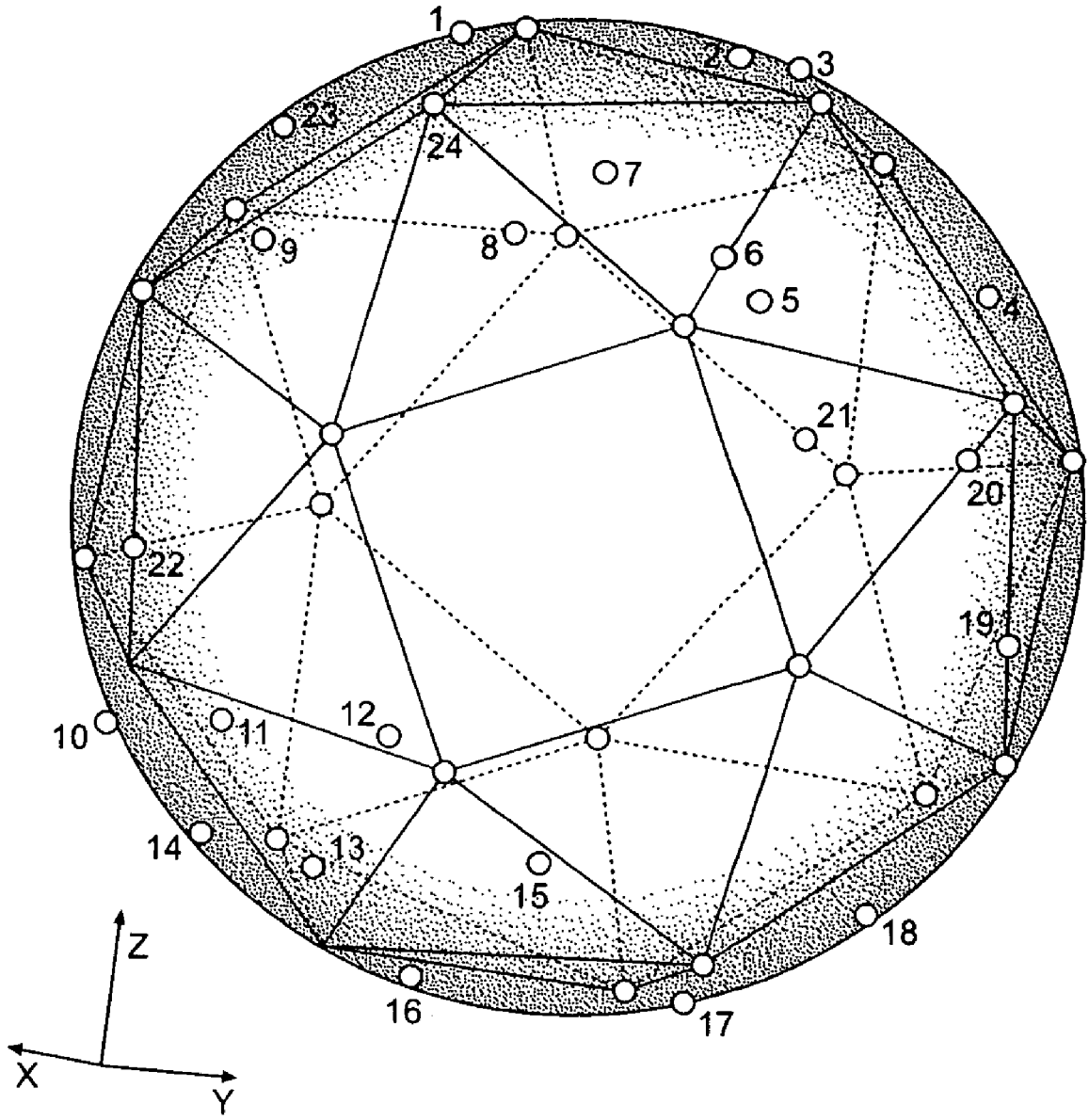
FIG. 4 is an example of an initial dimple arrangement of 24 dimples on a golf ball.

The second example uses the methods described herein to arrange 24 dimples on a golf ball. In this example, the initial dimple locations 1-24 once again are randomly arranged on the surface of the golf ball. The initial configuration of the dimple locations 1-24 is shown in FIG. 4. Charge values are assigned, and the potential, gradient, and minimum and average distances are again calculated. The process in repeated as described above for Example 1 until the dimple locations are optimized. Although the optimized dimples are not numbered, FIG. 4 shows the optimized positioning of the dimples, which coincide with vertices of an Archimedean shape.

Figure 5:
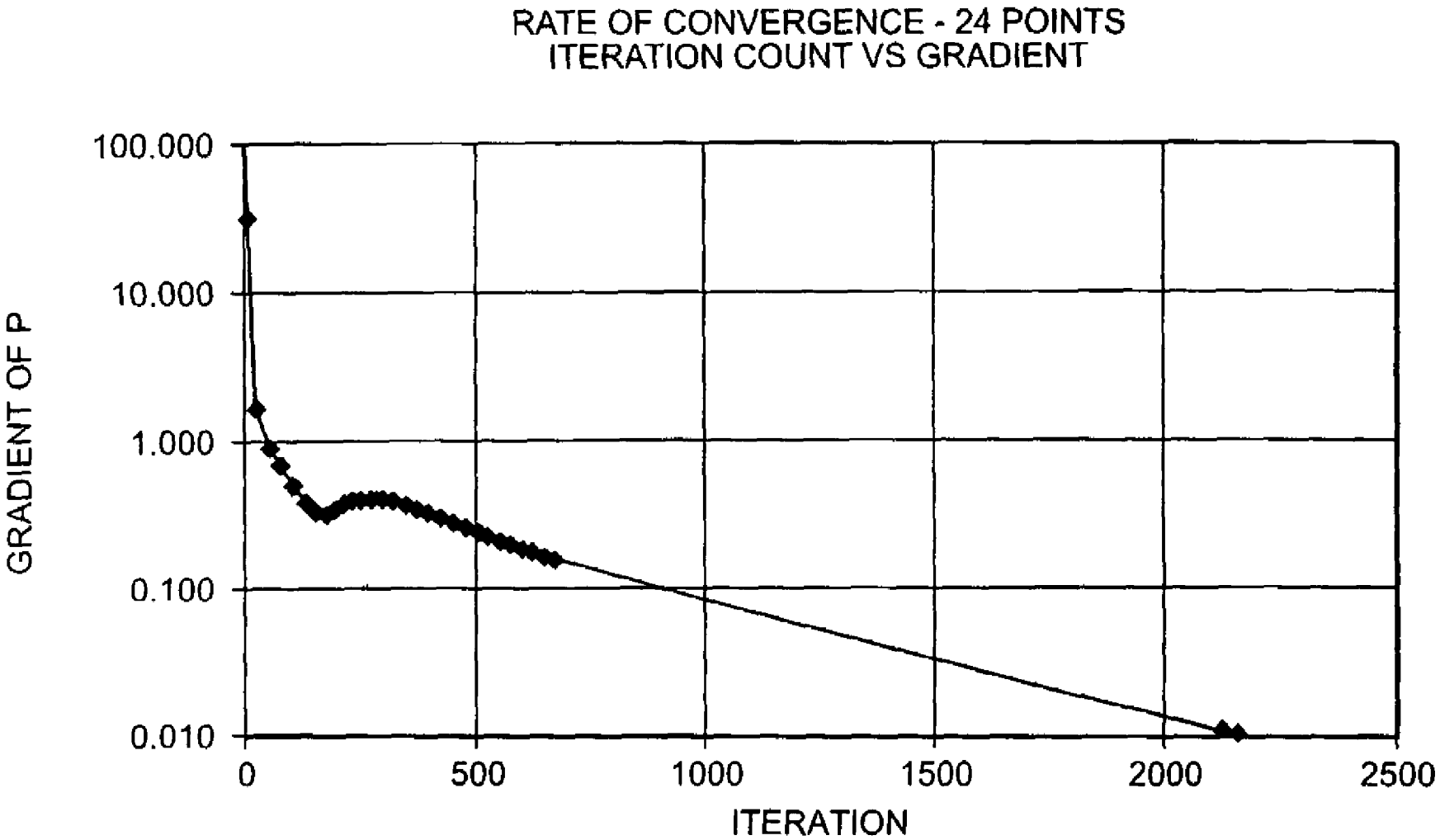
FIG. 5 is a graph of the rate of convergence for the example illustrated in FIG. 4.

As shown in FIG. 5, the rate of convergence again is was approximately linear. Table 2, below, provides illustrative data showing the calculations performed in this example. In this example, the process was stopped after 2160 iterations when the gradient reached an acceptable tolerance. Although not utilized in this Example, additional solution methods, including higher order methods, could be used to minimize the potential more rapidly.

As shown in Table 2, below, the iterative process was completed after the gradient was within an acceptable tolerance.

TABLE 2

| Iteration No. | Potential PE. | Gradient | Minimum Distance | At Vertices | Average Distance |
|---|---|---|---|---|---|
| 1 | 248.193 | 32.640 | 0.4433 | 4, 7 | 0.5996 |
| 26 | 224.125 | 1.700 | 0.6087 | 0, 2 | 0.6943 |
| 51 | 223.806 | 0.884 | 0.6253 | 3, 12 | 0.7041 |
| 76 | 223.653 | 0.677 | 0.6431 | 0, 2 | 0.7114 |
| 101 | 223.566 | 0.495 | 0.6566 | 0, 2 | 0.7158 |
| 126 | 223.520 | 0.372 | 0.667 | 0, 2 | 0.7178 |
| 151 | 223.491 | 0.317 | 0.6709 | 1, 3 | 0.7193 |
| 176 | 223.469 | 0.311 | 0.6709 | 1, 3 | 0.7205 |
| 201 | 223.453 | 0.349 | 0.6711 | 1, 3 | 0.7213 |
| 226 | 223.438 | 0.373 | 0.6714 | 1, 3 | 0.7222 |
| 251 | 223.424 | 0.384 | 0.6722 | 1, 3 | 0.7229 |
| 276 | 223.411 | 0.385 | 0.6736 | 1, 3 | 0.7236 |
| 301 | 223.400 | 0.378 | 0.6756 | 1, 3 | 0.7244 |
| 326 | 223.390 | 0.364 | 0.678 | 1, 3 | 0.7252 |

TABLE 2-continued

| Iteration No. | Potential PE. | Gradient | Minimum Distance | At Vertices | Average Distance |
|---|---|---|---|---|---|
| 351 | 223.383 | 0.345 | 0.6806 | 1, 3 | 0.7259 |
| 376 | 223.377 | 0.325 | 0.683 | 1, 3 | 0.7265 |
| 401 | 223.372 | 0.305 | 0.6853 | 1, 3 | 0.7271 |
| 426 | 223.369 | 0.285 | 0.6874 | 1, 3 | 0.7277 |
| 451 | 223.366 | 0.267 | 0.6893 | 1, 3 | 0.728 |
| 476 | 223.363 | 0.250 | 0.6909 | 1, 3 | 0.7284 |
| 501 | 223.361 | 0.234 | 0.6925 | 1, 3 | 0.7287 |
| 526 | 223.359 | 0.220 | 0.6939 | 1, 3 | 0.729 |
| 551 | 223.358 | 0.206 | 0.6953 | 1, 3 | 0.7293 |
| 576 | 223.356 | 0.194 | 0.6965 | 1, 3 | 0.7296 |
| 601 | 223.355 | 0.182 | 0.6977 | 1, 3 | 0.7299 |
| 626 | 223.354 | 0.172 | 0.6988 | 1, 3 | 0.7302 |
| 651 | 223.353 | 0.162 | 0.6999 | 1, 3 | 0.7304 |
| 676 | 223.352 | 0.152 | 0.7009 | 1, 3 | 0.7307 |
| 2126 | 223.347 | 0.011 | 0.7165 | 1, 3 | 0.7337 |
| 2151 | 223.347 | 0.010 | 0.7166 | 1, 3 | 0.7337 |
| 2160 | 223.347 | 0.010 | 0.7166 | 1, 3 | 0.7337 |

Example 3

Figure 6:
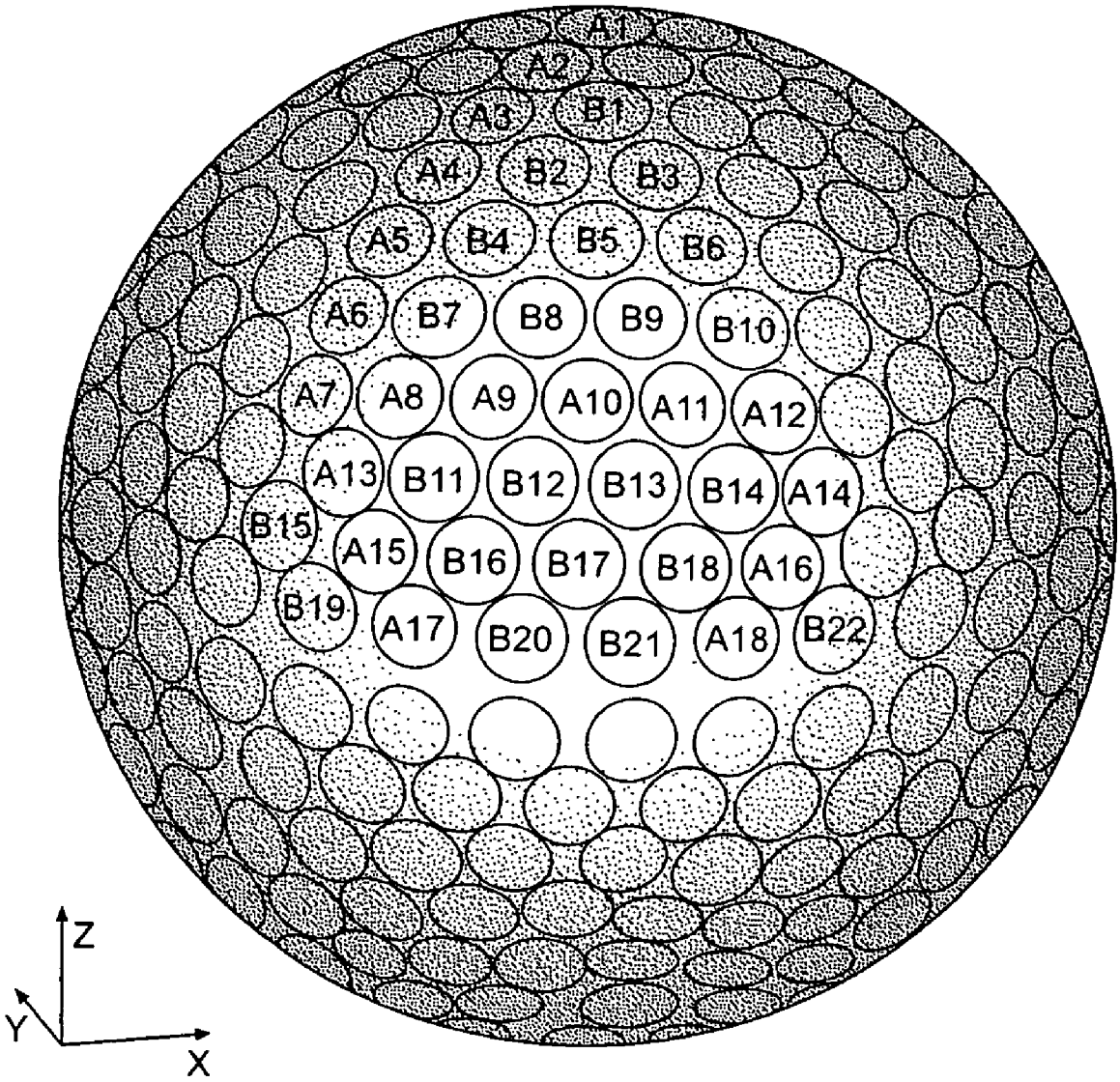
FIG. 6 is an example of an initial dimple configuration of 392 dimples on a golf ball.
Figure 7:
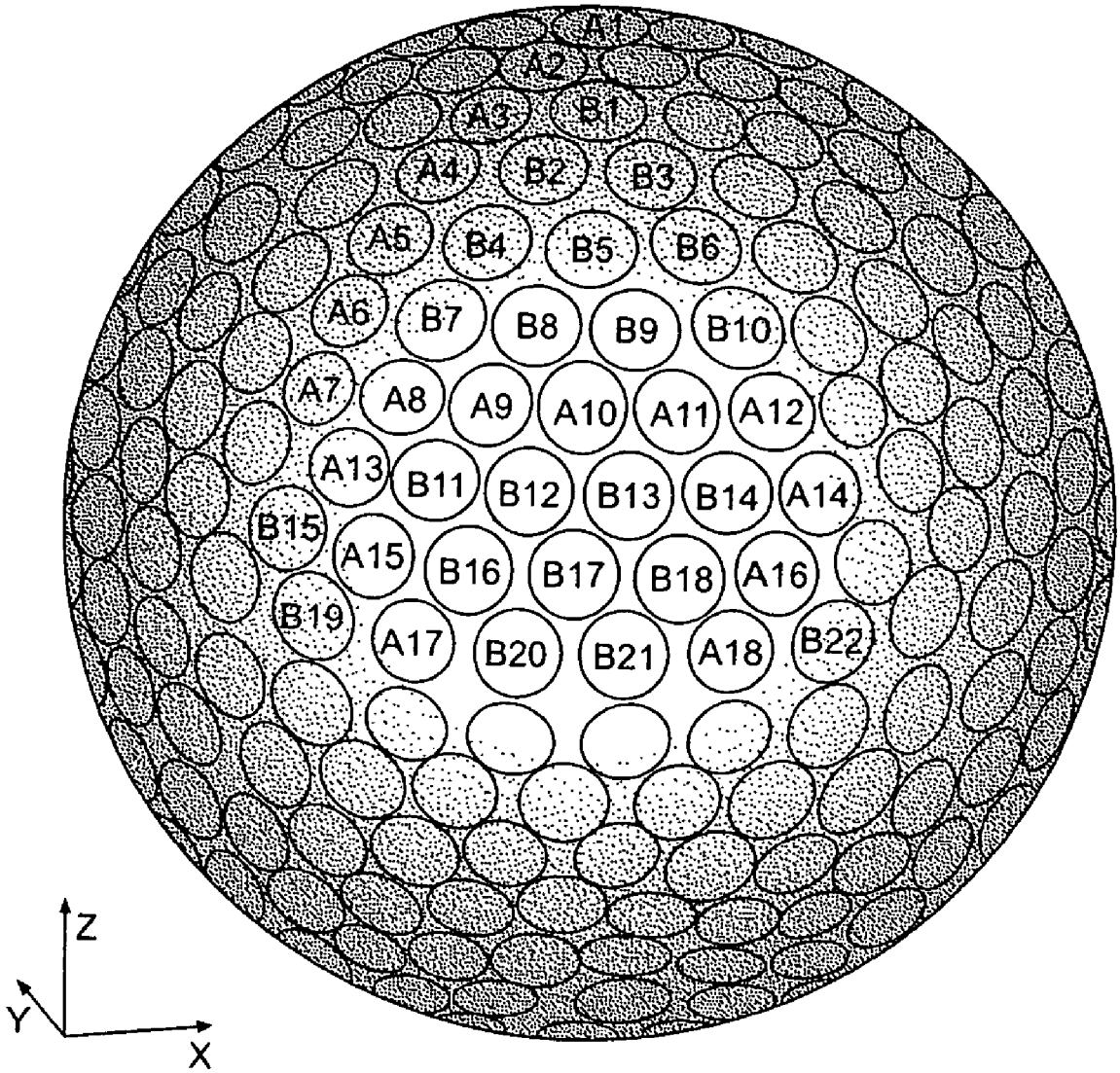
FIG. 7 illustrates a final configuration and spacing of dimples for the golf ball of FIG. 6.

FIGS. 6 and 7 show the initial and final dimple configurations for a 392-icosahedron dimple layout with two dimple diameters. It is provided that 392 circular dimples are distributed on the entire spherical surface of a golf ball. Using a computer, an initial distribution of dimples is set on a hemispherical surface of a golf ball model. The initial distribution shown in FIG. 6 is based on a conventional icosahedral arrangement of dimples. In this example, there are two dimple sizes on the ball. The first set of dimples have a diameter of about 0.139 inches, while the second set of dimples are about 0.148 inches in diameter. Each hemisphere of the ball has 196 dimples.

As seen in FIG. 6, the initial dimple pattern shows large polar spacing and tighter packing toward the equator of the ball, but maintains a sufficient setback from the equator of the ball. In this example, the defined space for redistributing the dimples is approximately a hemisphere with a constraint that the dimples not be placed within 0.006 inches from the parting line corresponding generally to the equator of the ball. Charge values are assigned to each dimple and the equations are applied and repeated until the gradient reaches a selected tolerance. As shown in FIG. 7, the dimple pattern that results from application of the present invention has the dimples more uniformly spaced from each other.

Although some preferred embodiments have been described, many modifications and variations may be made thereto in light of the above teachings without departing from the spirit and scope of the present invention. It is therefore to be understood that the invention may be practiced otherwise than specifically described without departing from the scope of the appended claims.

What is claimed is:

1. A method of forming a golf ball having a surface comprising a plurality of dimples arranged thereon, comprising the steps of:

defining a first portion of the surface in which the plurality of dimples will be arranged;

triangulating the first portion of the surface to form a triangulated surface pattern;

generating a dimple arrangement for the first portion comprising Soddy circles, wherein the Soddy circles are based on the vertices of the triangulated surface pattern; and forming a golf ball comprising an outer cover comprising the dimple arrangement.

2. The method of claim 1, further comprising modifying one or more Soddy circle radii if two or more circles overlap.

3. The method of claim 1, wherein the first portion of the surface comprises the entire surface of the golf ball.

4. The method of claim 1, wherein the dimple arrangement in the first portion is repeated on other portions of the golf ball.

5. The method of claim 1, wherein the total dimple coverage is about 60% or greater.

6. The method of claim 1, wherein the triangulation and pattern generated are based on a computer program.

7. The method of claim 1, wherein the triangulation comprises generating two or more triangulated surface patterns.

8. The method of claim 1, wherein the triangulation comprises a plurality of triangles, wherein the angles of the triangles comprise obtuse, oblique, equilateral, or any combination thereof.

9. The method of claim 1, wherein the triangulated surface pattern is randomly generated.

10. The method of claim 1, wherein the triangulated surface pattern is based on at least one polyhedra or Archimedean solids.

11. The method of claim 1, further comprising optimizing the positioning of dimples based on the electromagnetic theory.

12. The method of claim 1, further comprising the steps of:

defining a second portion of the surface in which a second plurality of dimples will be arranged;

placing a second plurality of dimples within the defined second portion;

assigning charge values to the second plurality of dimples;

applying Coulomb's Law to determine the potential of the charge values;

applying a first solution method to minimize the potential; and altering the dimple location and distribution according to the solution method.

13. The method of claim 12, wherein the first and second portions include regions where no dimples can be defined.

14. The method of claim 12, wherein the dimples comprise varied cross-sections.

15. A method of forming a golf ball having a surface comprising a plurality of dimples, comprising the steps of:

defining a first portion of the surface in which at least a portion of the plurality of dimples will be arranged;

determining a dimple pattern for the first portion based on circle packing theory;

defining a second portion of the surface in which at least another portion of the pluarity of dimples will be arranged;

triangulating the second portion of the surface to form a triangulated surface pattern;

generating Soddy circles based on the vertices of the triangulated surface pattern; and positioning dimples on the second portion based on the Soddy circles, wherein at least about 80 percent of the surface is covered with dimples; and forming a golf ball cover on the golf ball comprising the first and second portions.

16. The method according to claim 15, wherein substantially all of the dimples in the first portion are mutually tangent to at least three neighboring dimples.

17. The method according to claim 15, wherein the step of determining a dimple pattern further comprises arranging a pluarity of circles where at least some of the circles are mutually tangent.

18. The method according to claim 15, wherein the step of determining a dimple pattern is based on a predetermined number of different circle diameters.

19. The method according to claim 15, wherein the step of determining a dimple pattern is based on a predetermined number of fixed circle positions.

20. The method according to claim 15, wherein the step of determining a dimple pattern is based on circles having two or more substantially different diameters.

21. The method according to claim 15, wherein the step of determining a dimple pattern is based on circles having substantially similar diameters.

22. The method according to claim 15, further comprising repeating the pattern on other portions of the golf ball.

23. The method according to claim 15, wherein at least one dimple within the first portion overlaps at least one adjacent dimple within the second portion, wherein the percentage overlap is between about 1% and about 5% of the average neighboring dimple diameters.

24. The method according to claim 15, wherein at least one dimple within the first portion overlaps at least one adjacent dimple within the second portion, wherein the percentage overlap is between about 2% and about 4% of the average neighboring dimple diameters.

25. A method of forming a golf ball having a surface comprising a plurality of dimples, comprising the steps of:

defining a first portion of the surface in which at least a portion of the plurality of dimples will be arranged;

positioning dimples within the first portion based on circle packing theory and a predetermined number of different circle diameters;

defining a second portion of the surface in which dimples will be arranged;

triangulating the second portion of the surface to form a triangulated surface pattern;

generating Soddy circles based on the vertices of the triangulated surface pattern;

modifying one or more Soddy circle radii if two or more circles overlap;

positioning dimples on the second portion based on the Soddy circles; and forming a golf ball cover on the golf ball comprising the first and second portions.

* * * * *